US005713561A

United States Patent [19]

Sugiyama

[11] Patent Number: 5,713,561

[45] Date of Patent: Feb. 3, 1998

[54] OUTDOOR STRUCTURE SUCH AS GATE POST GATE WING OR FENCE AND METHOD FOR CONSTRUCTING THIS

[75] Inventor: Shigeyuki Sugiyama, Nigano-Ken, Japan

[73] Assignee: Toyo Exterior Co., Ltd., Tokyo, Japan

[21] Appl. No.: 579,874

[22] Filed: Dec. 28, 1995

[30] Foreign Application Priority Data

Dec. 30, 1994 [JP] Japan ..... 6-339570

[51] Int. Cl.[6] ..... E04H 17/14

[52] U.S. Cl. ..... 256/19; 256/1; 256/50; 52/314; 52/387

[58] Field of Search ..... 256/19, 1, 13.1, 256/50, 66; 52/314, 387, 386, 511, 315, 506.01, 506.05, 169.12; 405/284, 286

[56] References Cited

U.S. PATENT DOCUMENTS

| | | | |
|---|---|---|---|
| 1,673,630 | 6/1928 | Madge | 52/314 X |
| 1,951,711 | 3/1934 | Stitt | 52/511 |
| 2,195,905 | 4/1940 | Stanley | 52/511 |
| 2,317,231 | 4/1943 | Swedman . | |
| 3,248,834 | 5/1966 | Polis | 52/387 |
| 3,701,228 | 10/1972 | Taylor . | |
| 4,001,361 | 1/1977 | Unruh | 52/169.12 |
| 4,026,083 | 5/1977 | Hoyt et al. | 52/387 |
| 4,275,540 | 6/1981 | Keller | 52/314 |
| 4,644,719 | 2/1987 | Salazar . | |
| 4,809,470 | 3/1989 | Bauer et al. | 52/97 |
| 4,858,410 | 8/1989 | Goldman | 52/387 X |
| 4,881,348 | 11/1989 | Davis | 52/511 X |
| 4,899,513 | 2/1990 | Morris . | |
| 4,920,716 | 5/1990 | Coffey . | |
| 4,944,124 | 7/1990 | Armstrong | 52/169.12 |
| 5,228,857 | 7/1993 | Roland . | |
| 5,228,937 | 7/1993 | Passeno . | |
| 5,232,646 | 8/1993 | Nasvik et al. | 264/133 |
| 5,274,982 | 1/1994 | Price | 52/747 |
| 5,373,676 | 12/1994 | Francis et al. | 52/387 |
| 5,404,685 | 4/1995 | Collins | 256/19 X |
| 5,421,558 | 6/1995 | Vesper . | |
| 5,501,049 | 3/1996 | Francis et al. | 52/387 |

FOREIGN PATENT DOCUMENTS

| | | | |
|---|---|---|---|
| 24360 | 3/1981 | European Pat. Off. | 52/314 |
| 718778 | 11/1954 | United Kingdom | 52/314 |

*Primary Examiner*—Anthony Knight
*Assistant Examiner*—Bruce A. Lev
*Attorney, Agent, or Firm*—Ladas & Parry

[57] ABSTRACT

A structure such as a gate post, gate wing or fence of reduced weight to allow easier transportation and installation of the same, as well as to facilitate the fixation of artificial stones. Artificial stones are molded in a predetermined number of different shapes and a substrate is expansion-molded from foam plastics. Artificial stone receiving recesses are molded integrally with the substrate so as to be paired with the respective artificial stones, which are inserted into the corresponding recesses so that such insertion may serve as a provisional fixation to prevent the artificial stones from falling or scaling before setting of the adhesive agent bonding the artificial stones to their receiving recesses. A protruding rib bordering and defining the receiving recesses serves as a joint base adapted to support the overlying joint mortary.

19 Claims, 3 Drawing Sheets

OUTDOOR STRUCTURE SUCH AS GATE POST GATE WING OR FENCE AND METHOD FOR CONSTRUCTING THIS

BACKGROUND OF THE INVENTION

1. Field of the Invention

The present invention relates to an outdoor structure such as gate post, gate wing or fence.

2. Description of the Related Art

Such outdoor structures have conventionally been constructed by adhesively placing tiles, natural stones, artificial stones etc. on an inorganic substrate such as concrete substrate or mortar substrate using, for example, mortar adhesion substantially according to the traditional method for adhesive placement of them on outer wall of a building. For example, when the tiles are adhesively placed on the mortar substrate, the mortar substrate is formed on its surface with protruding rib destined to be engaged with corresponding ridge formed on a rear surface of each tile so that the desired adhesive placement may be effectively assisted by such engagement serving as provisional fixation means.

However, mass production of the outdoor structure such as gate post, gate wing or fence comprising the inorganic substrate and said artificial stones adhesively placed thereon would require a crane for transport and installation thereof because the structure constructed in a plant will be inconveniently bulky and heavy. In view of work efficiency, there has been a serious demand for the outdoor structure of light weight.

As is well known, the tiles are usually obtained by cutting extruded long molding followed by sintering treatment and can be easily formed on their rear surfaces with the ridges cooperating with the protruding rib formed on the mortar substrate. On the other hand, the artificial stones are usually obtained by casting mortar or the like into various sizes as well as shapes and can not be easily formed with the ridges or the like with sufficient accuracy to be used as the provisional fixation means. In addition, the artificial stones obtained by casing of mortar are relatively heavy and apt to scale or fall off from the substrate during the adhesive placement under their dead loads. If, to avoid such falling off, the substrate is laid down so that its side on which the artificial stones will be adhesively placed may horizontally extend, the production efficiency would be unacceptably reduced, because the operator must wait for setting of the adhesive agent before the next side of the same substrate can be worked.

SUMMARY OF THE INVENTION

In view of the problem as has been described above, it is a principal object of the invention to provide an outdoor structure such as gate post, gate wing or fence so improved that the structure's weight can be reduced as significantly as possible, the adhesive placement of artificial stones can be achieved as efficiently as possible and the product as well as the method can be adapted for mass production.

The object set forth above is achieved, according to an aspect of the invention, by an outdoor structure such as gate post, gate wing or fence comprising a substrate as a primary component made of foamed plastics for weight reduction, artificial stones molded in a predetermined number of different shapes common to each type of the structure in order to improve an effciency for adhesive fixation of the artificial stones and a protruding rib provided on the substrate defining respective artificial stone receiving recesses into which the artificial stones of the shapes corresponding to the respective receiving recesses are inserted. Such insertion of the artificial stones into the corresponding receiving recesses serves as provisional fixation means for final adhesive fixation of the artificial stones and the protruding rib serves also as a joint base adapted to support the overlying joint material in order to save a necessary amount of joint material and thereby to achieve further weight reduction. More specifically, the object set forth above is achieved, in accordance with the invention, by an outdoor structure such as gate post, gate wing or fence comprising a plurality of artificial stones, a substrate made of foamed plastics having a surface on which said artificial stones are adhesively fixed, and joint disposed on the surface of said substrate between respective pairs of adjacent artificial stones, said outdoor structure being characterized by that there are provided a plurality of said artificial stones molded in a predetermined number of different shapes; said substrate is provided in its surface with a plurality of artificial stone receiving recesses having different shapes corresponding to the shapes of the respective artificial stones, each of said artificial stone receiving recesses being defined by a rib of foamed plastics protruding from the surface of said Substrate and lower than a thickness of the artificial stones; these artificial stones are adhesively inserted into the corresponding receiving recesses as a provisional fixation procedure for said adhesive fixation; and said protruding rib serves as a joint base adapted to support the overlying joint material.

To facilitate formation of the protruding rib on the substrate as well as of the artificial stone receiving recesses, this protruding rib and artificial stone receiving recesss are preferably molded integrally with the substrate from foam plastics.

Preferably, the artificial stones as well as the artificial stone receiving recesses are post-attached to a molding of thin-board-like foamed plastics or a meshy molding of foamed plastics defining the protruding rib is post-attached to the substrate.

By providing the subsrate made of foamed plastics, it becomes possible to attach an anchoring member to each artificial stone and thereby to utilize this anchoring member as provisional fixation means being able to hold this artificial stone when said anchoring member penetrates the substrate as the artificial stone is inserted into the corresponding receiving recess. Accordingly, said artificial stones are preferably provided additionally with an anchoring members partially embedded therein and partially projecting out from the rear surfaces of the respective artificial stones so that said projecting portions of the anchoring members penetrate the substrate as the artificial stones are adhesively inserted into the corresponding receiving recesses and said penetration serves as further provisional fixation means for the final adhesive fixation.

The object set forth above is achieved also, according to another aspect of the invention, by a method for producing an outdoor structure such as gate post, gate wing or fence using a plurality of artificial stones molded in a predetermined number of different shapes and a substrate made of foamed plastics and provided on its surface with a protruding rib made of foamed plastics but of a height smaller than a thickness of each artificial stone, on one hand, and provided in its surface with artificial stone receiving recess defined by said protruding rib so as to correspond to said artificial stones with respect to the number as well as the shapes, on the other hand, said artificial stones and said artificial stone receiving recesses being provided with mutually paired marks, said method comprising steps of adhesively inserting the artificial stones into the artificial stone receiving recesses having the corresponding marks, respectively; embedding joint material in a gap defined between respective pairs of adjacent artificial stones so that said protruding rib may serve as a joint base adapted to support the overlying joint material; and adhesively fixing the artificial stones in the corresponding receiving recesses by setting of suitable adhesive agent with assistance of said insertion serving as provisional fixation procedure.

As will be readily understood from the foregoing description, the invention sufficiently reduces weight of the outdoor structure to be manually transported and installed without use of a crane. The artificial stones are molded in a predetermined number of different shapes which are common to each type of the outdoor structures and the substrate is formed with the artificial stone receiving recesses corresponding to said artificial stones, respectively, so that the artificial stones may be inserted into the corresponding receiving recesses and such insertion may be used as provisional fixation procedure for the final adhesive fixation of the artificial stones. In this manner, the final adhesive fixation of the artificial stones can be reliably and firmly achieved while the artificial stones are maintained in their provisionally fixed positions without an apprehension that they might scale off or fall off due to their dead loads, movement or vibration. The adhesive fixation of the artificial stones can be thus carried out as easily as possible particularly in a manner suitable for mass production. In addition, the protruding rib defining the respective artificial stone receiving recesses can be used as the joint base adapted to support the overlying joint material and thereby a necessary amount of the joint material can be saved so that the joint mortar usually employed for the same purpose may be employed as the joint material without loss of the desired weight reducing effect.

Each artificial stone and the receiving recess paired with this artificial stone are provided with identical marks in order to facilitate identification of the respectively paired artificial stone and receiving recess and thereby to provide the method allowing even an inexperienced operator to produce the desired structure with high efficiency.

Function provided by the anchoring member to hold the artificial stone as it penetrates the substrate serves as further provisional fixation means for the final adhesive fixation and cooperates with the provisional fixation means provided by the adhesive insertion of the artificial stones into the respective receiving recesses to assure more reliable and firm provisional fixation.

DESCRIPTION OF THE PREFERRED EMBODIMENT

Figure 1:
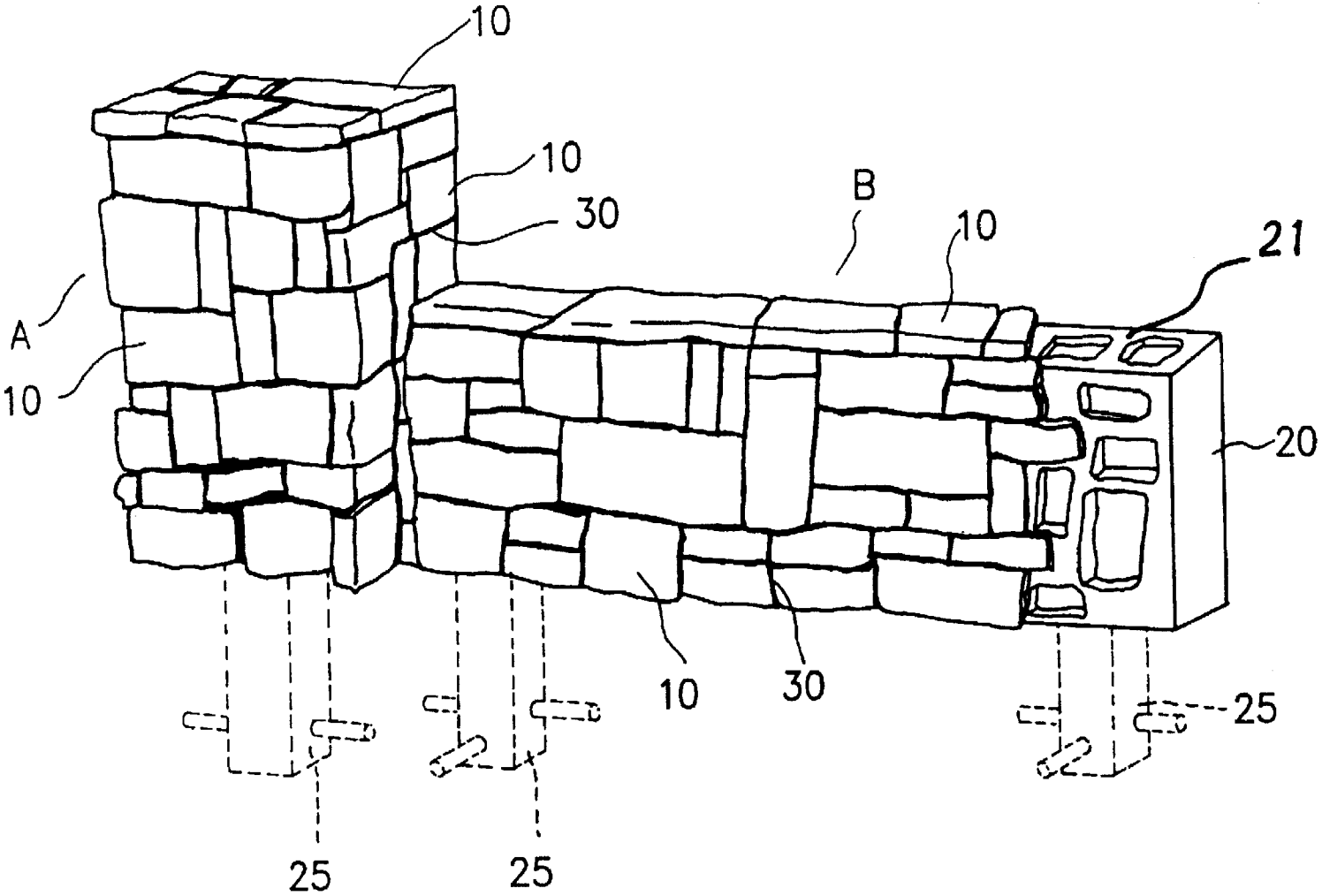
FIG. 1 is a perspective view showing a gate post and a fence, the latter being shown as partially broken away.
Figure 2:
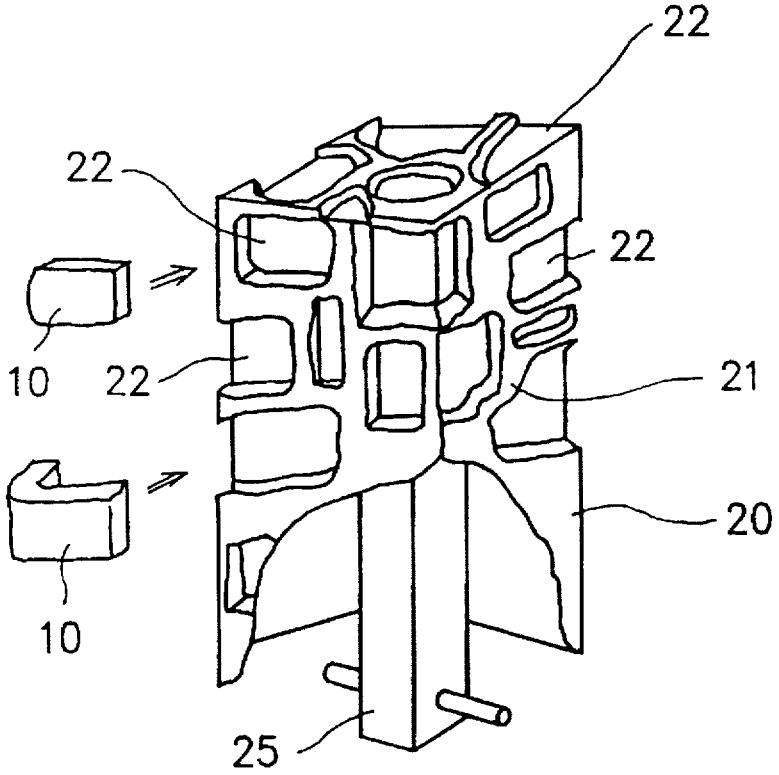
FIG. 2 is a perspective view showing a substrate of the gate post as partially broken away.
Figure 3:
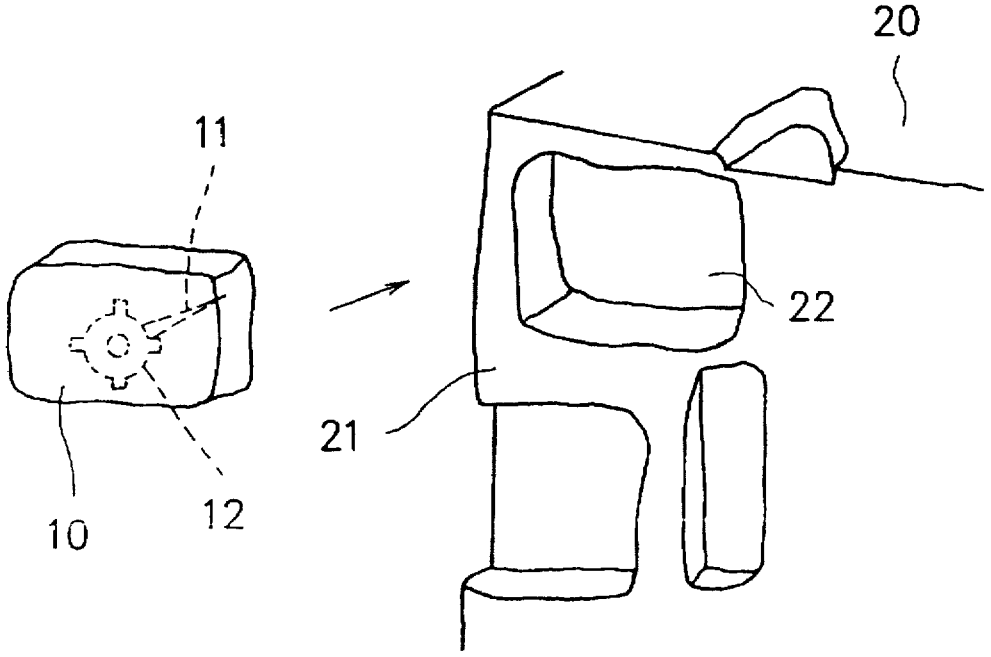
FIG. 3 is a scale-enlarged fragmentary perspective view illustrating a relationship between the substrate and the artificial stone.
Figure 4:
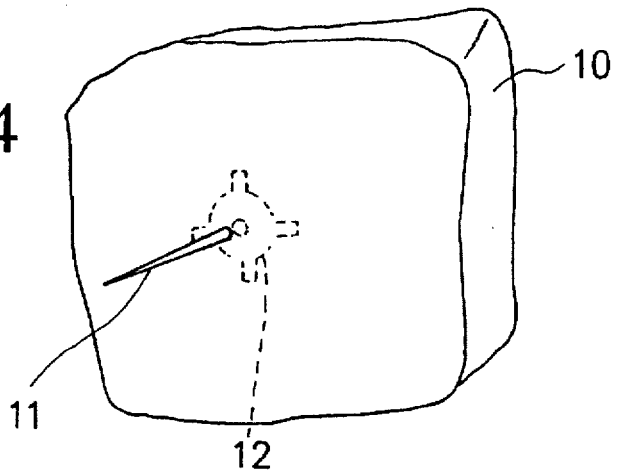
FIG. 4 is a perspective view of an artificial stone as viewed from its rear side.
Figure 5:
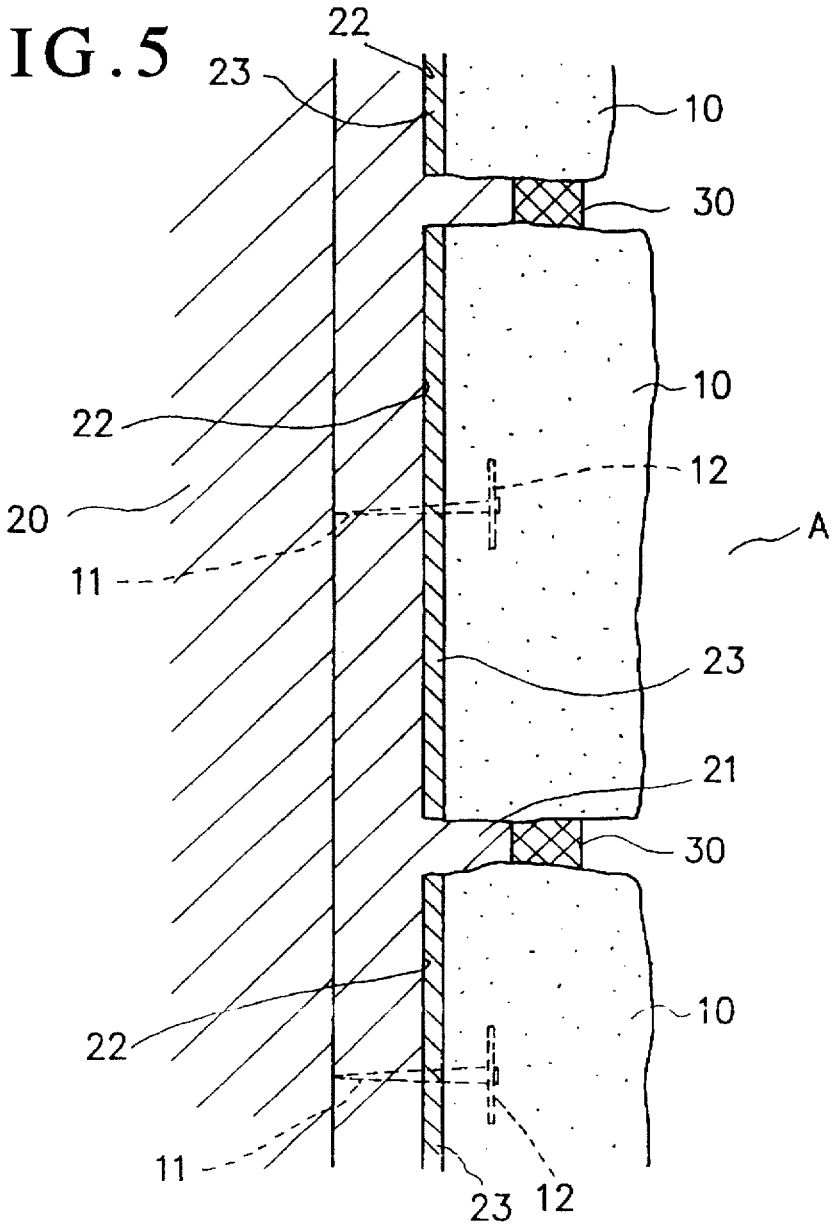
FIG. 5 is a scale-enlarged vertical sectional view showing a part of the gate post.

Details of the invention will be better understood from the following description of preferred embodiments made in reference with the accompanying drawings. Reference letter A designates a gate post and reference letter B designates a fence butt-jointed to said gate post A. The gate post A or the fence B comprises a plurality of artificial stones 10, a substrate 20 made of foamed plastics into which said artificial stones 10 are adhesively inserted, and joint 30 disposed between respective pairs of adjacent artificial stones 10 inserted into said substrate 20 so as to form a unit destined to be fixedly installed on the ground surface.

The artificial stones 10 are those molded in predetermined number of different shapes and, in the specific embodiment illustrated, the artificial stones 10 are molded from mortar and colored like natural stones. These artificial stones 10 are molded in predetermined number of different shapes and in an average thickness of about 3 cm. According to this embodiment, each of the artificial stones 10 is provided with an anchoring member 11 comprising a seat disc 12 embedded in the stone and a nail projecting out from said seat disc 12 through a rear surface of the stone.

The substrate 20 is formed on its surface a protruding rib 21 made of foamed plastics which has a height smaller than the thickness of the artificial stone and a plurality of artificial stone receiving recesses 22 bordered or defined by the protruding rib 21 in conformity with the respective shapes of the artificial stones 10. The protruding rib 21 and the artificial stone receiving recesses 22 are molded integrally with the substrate 20 which is also made of foamed plastics.

For example, the substrate 20 of the gate post A may be dimensioned to be 45 cm in width as well as in depth and 1 to 2 m in height while the substrate 20 of the fence B may be dimensioned to be 1 m in width, 20 cm in depth and 60 cm in height. Each of these substrates 20 is solid and expansion molded from foam plastics such as polystyrene so that the outer layer and the core of said substrate may be expanded at different expansion ratios. More specifically, the process of expansion molding is preferably controlled to be effected at an expansion ratio of 10 in the outer layer of 1 to 2 cm and at an expansion ratio of 50 in the core so that the outer layer may be relatively hard but the core may be relatively soft. The protruding rib 21 is expansion molded at the same expansion ratio as that in the outer layer so as to become relatively hard. Thereby, not only an effective weight reduction of the substrate can be achieved but also the artificial stone receiving recesses 22 can reliably hold the artificial stones 10 as will be described later more in detail.

In this embodiment, the protruding rib 21 is distributed over the entire surface of the substrate 20 except the bottom surface thereof and is dimensioned to have a height, for example, of 1 cm which is smaller than an average thickness of said artificial stones which may be 3 cm while a depth of the artificial stone receiving recess 22 is correspondingly dimensioned to be 1 cm.

Adhesive insertion of the artificial stones 10 into the substrate 20 is achieved first by adhesively inserting the artificial stones 10 into the receiving recesses 22 and such insertion serves as provisional fixation means. The anchoring members 11 carried by the respective artificial stones 10 penetrate the substrate 10 as said artificial stones 10 are adhesively inserted into the respective receiving recesses 22 and such penetration of the anchoring members 11 serves as further provisional fixation means.

Specifically, adhesive mortar 23 is applied to the artificial stones 10 or the receiving recesses 22 of the substrate 20 before the process of said adhesive insertion so that the desired adhesive fixation may be effected by setting of said adhesive mortar 23. During insertion of the artificial stones 10 into the receiving recesses 22, the protruding rib 21 associated with these receiving recesses 20 holds the artificial stones 10 by its elasticity peculiar to foamed plastics and provisionally fixes the artificial stones 10, thus preventing these artificial stones 10 from scaling off or falling off from the receiving recesses 22 due to their dead loads, movement, vibration or the other causes. Additionally, once the needle of the anchoring member 11 has penetrated the substrate 20, the latter holds this needle by its elasticity against falling off and provides a secondary fixing effect against said scaling off or falling off of the artificial stones 10. In this manner, this embodiment allows the provisional fixation to be reliably and firmly achieved so that the adhesive mortar 23 may be set with the artificial stones 10 being maintained adhesively inserted into the respective receiving recesses 22.

This embodiment uses joint mortar as material for the joint 30 which is to be embedded in a gap defined between respective pairs of adjacent artificial stones 10 and said protruding rib 21 distributed over the substrate 20 functioning as a joint base adapted to support the overlying joint 30.

As has already been described, the protruding rib 21 distributed over the substrate 20 fills the gap defined between respective pairs of adjacent artificial stones 10 up to a height of 1 cm in conformity with a pattern of the joint 30. The protruding rib 21 serves as the joint base adapted to support the joint mortar from below and thereby to supplement a volume thereof. As a result, the joint of a predetermined height, for example, the joint having its top surface lying at a level lower than the top surfaces of the artificial stones 10 by 1 cm can be formed by using a relatively small amount of joint mortar and such feature also contributes to the weight reduction of the finished gate post A or the fence B.

Reference numeral 25 designates a pile to be buried into the ground for installation of the gate post A or the fence B, wherein a single pile 25 may be provided for the gate post A and a pair of piles 25 may be provided at longitudinally opposite ends for the fence B.

The gate post A or the fence B of the above-mentioned constructionas may be produced according to a method comprising steps of, during or after molding the artificial stones 10 as well as the substrate 20, pressing, writing or stamping suitable marks such as numerals, letters or figures on the artificial stones 10 and the receiving recesses 22 formed in the substrate 20, said marks corresponding to each other for every pair of mutually associated artificial stone 10 and receiving recess 22 in order to assure that the respective artificial stones 10 may be adhesively inserted into the associated receiving recesses 22; embedding the joint material into the gap defined between the respective pairs of adjacent artificial stones 10 so as to be supported by the underlying rib 21 serving as the joint base; and adhesively fixing the artificial stones 10 by setting of adhesive agent cooperating with said insertion serving as provisional fixation procedure.

While both the artificial stones 10 and the receiving recesses 22 are of a plurality of different shapes and sizes, the number of these shapes and sizes are limited and predetermined so that it is possible for a skilled operator to identify the artificial stones 10 and the receiving recesses 22 into which these artificial stones 10 should be inserted, respectively, without providing these artificial stones 10 and the receiving recesses 22 with the previously mentioned marks. However, these marks facilitate even an inexperienced operator to identify the mutually corresponding or paired artificial stone 10 and receiving recess 22 and improve an efficiency of the identification as well as the adhesive insertion based on said identification. During the step of adhesive insertion, identification of the artificial stones 10 and the associated receiving recesses 22 may be performed collectively or individually and the adhesive agent such as adhesive mortar 23 may be applied to the artificial stones 10 and/or the receiving recesses 22 before adhesive insertion of the artificial stones 10 into the receiving recesses 22.

The step of embedding the joint may be performed by supplying the joint material such as joint mortar into the gap defined between the respective pairs of adjacent artificial stones 10 so that the protruding rib 21 may support the joint from below as the joint base.

The step of adhesive fixation may be performed, when the adhesive mortar 23 or the like is used as the adhesive agent and the joint mortar is used as the joint material, by setting them under natural seasoning or heat drying. The gate post A or the fence B may be transported to the site of installation before this step of adhesive fixation because artificial stones 10 have already been provisionally fixed.

It should be understood here that the invention is not limited to the embodiment as has been described hereinabove in reference with the accompanying drawings. For example, the artificial stones may be moldings of rigid plastics. When anchoring member is employed, the previously mentioned anchoring member having a single nail may be replaced by an anchoring member made of metallic material or rigid plastics comprising a plurality of nails and a seat disc. The substrate may be a single molding of foam plastics or a composite molding comprising a plurality of moldings bonded together, or may be formed by a core such as a frame and a base layer of thick foamed plastics covering the core. Expansion ratio of foam plastics may be selected from a wide range and, if desired, an expansion ratio may be common to the outer layer and the core. The protruding rib and the artifical stone receiving recesses may be post-attached to a thin-board-like molding of foam plastics or a meshy molding of foam plastics defining the protruding rib may be post-attached to the substrate. Adhesive agent other than the adhesive mortar may be also used for adhesive fixation of the artificial stones. Moldings configured in conformity with a pattern of the joint may be also used as the joint material and embedded into the gap defined between the respective pairs of adjacent artifical stones so as to be supported by the underlying rib. The invention is applicable to the various outdoor structures other than the gate post and the fence, for example, the gate wing. It should be understood that, without departing from the scope and the spirit of the invention, there can be provided many variations and/or modifications in the specific arrangement, configuration, material, number, dimension and their mutual relationship of the artificial stones, the protruding rib, the artificial stone receiving recesses, the anchoring members, if they are employed, the marks provided on the artificial stones and the receifing recesses, also if they are employed, and the specific steps for production thereof.

What is claimed is:

1. A structure comprising:

a plurality of artificial stones having a variety of shapes;

a substrate made of elastic foamed plastic material, said substrate having a surface and being provided on its surface with a plurality of artificial stone receiving recesses having a variety of shapes corresponding to the variety of shapes of the plurality of artificial stones; and a joint disposed on the substrate surface between respective pairs of adjacent artificial stones;

the plurality of artificial stones being adhesively fixed to the substrate and being inserted into the corresponding receiving recesses serving as a provisional fixation by the elasticity of the elastic foamed plastic material.

2. The structure of claim 1, wherein:

the substrate is made of a single molding of an elastic foamed plastic material.

3. The structure of claim 1, wherein:

the substrate is a composite having a plurality of moldings bonded together.

4. The structure of claim 1, wherein:

said artificial stones are additionally provided with anchoring members partially embedded therein and partially projecting out from a rear surface of the respective artificial stones so that said members penetrate the substrate as the artificial stones are adhesively inserted into the corresponding receiving recesses, thereby serving as further provisional fixation means for said adhesive fixation.

5. A structure comprising:

a plurality of artificial stones having a variety of shapes;

a substrate made of an elastic foamed plastic material, said substrate having a surface and being provided on its surface with a plurality of artificial stone receiving recesses and a plurality of ribs protruding from the substrate surface, said recesses being defined and bordered by said protruding ribs in conformity with the respective variety of shapes of the artificial stones, each of the ribs having a height smaller than a thickness of the artificial stone it borders;

the artificial stones being adhesively fixed to the substrate and being inserted into the corresponding receiving recesses serving as a provisional fixation by the elasticity of the elastic foamed plastic material; and a joint disposed on the surface of the substrate between respective pairs of adjacent artificial stones, said joint having a joint base defined by the ribs, said joint base adapted to support a joint material overlying the ribs and disposed between respective pairs of adjacent artificial stones.

6. The structure of claim 5, wherein:

the artificial stone receiving recesses defined by the protruding ribs are integrally formed with the substrate.

7. The structure of claim 5, wherein:

the substrate is made of a single molding of an elastic foamed plastic material.

8. The structure of claim 5, wherein:

the substrate is a composite having a plurality of moldings bonded together.

9. The structure of claim 5, wherein:

said artificial stones are additionally provided with anchoring members partially embedded therein and partially projecting out from a rear surface of the respective artificial stones so that said members penetrate the substrate as the artificial stones are adhesively inserted into the corresponding receiving recesses, thereby serving as further provisional fixation means for said adhesive fixation.

10. A structure comprising:

a plurality of artificial stones in predetermined different shapes;

a substrate made of solid elastic foamed plastic material provided with a surface, a plurality of artificial stone receiving recesses on the surface, and ribs protruding from the surface, the ribs bordering and defining the recesses in a manner corresponding to the respective different shapes of the artificial stones;

the receiving recesses and the protruding ribs being made of relatively harder elastic foamed plastic material at a relatively lower expansion ratio than the rest of the substrate, the artificial stones being adhesively fixed to the substrate and being inserted into the corresponding receiving recesses serving as a provisional fixation by the elasticity of the elastic foamed plastic material; and a joint disposed on the surface of the substrate between respective pairs of adjacent artificial stones.

11. The structure of claim 10, wherein:

the artificial stone receiving recesses defined by the ribs are integrally formed with the substrate.

12. The structure of claim 10, wherein:

the substrate is made of a single molding of an elastic foamed plastic material.

13. The structure of claim 10, wherein:

the substrate is a composite having a plurality of moldings bonded together.

14. The structure of claim 10, wherein:

said artificial stones are additionally provided with anchoring members partially embedded therein and partially projecting out from a rear surface of the respective artificial stones so that said members penetrate the substrate as the artificial stones are adhesively inserted into the corresponding receiving recesses, thereby serving as further provisional fixation means for said adhesive fixation.

15. A structure comprising:

a plurality of artificial stones in a predetermined number of different shapes;

a solid substrate having an outer portion and an inner core both made of an elastic foamed plastic material having respectively different expansion ratios, the outer portion being made of a relatively harder elastic foamed plastic material at a relatively lower expansion ratio to that of the inner core, and the inner core being made of a relatively softer elastic foamed plastic material at a relatively higher expansion ratio to that of the outer portion;

the outer portion provided with a surface having a plurality of protruding ribs, and a plurality of artificial stone receiving recesses defined by the protruding ribs, the artificial stones being adhesively fixed to the substrate and being inserted into the corresponding receiving recesses as a provisional fixation by the elasticity of the elastic foamed plastic material; and a joint disposed on the surface of the substrate between respective pairs of adjacent artificial stones.

16. The structure of claim 15, wherein:

the artificial stone receiving recesses defined by the protruding ribs are integrally formed with the substrate.

17. The structure of claim 15, wherein:

the substrate is made of a single molding of an elastic foamed plastic material.

18. The structure of claim 15, wherein:

the substrate is a composite having a plurality of moldings bonded together.

19. The structure of claim 15, wherein:

said artificial stones are additionally provided with anchoring members partially embedded therein and partially projecting out from a rear surface of the respective artificial stones so that said members penetrate the substrate as the artificial stones are adhesively inserted into the corresponding receiving recesses, thereby serving as further provisional fixation means for said adhesive fixation.

* * * * *

UNITED STATES PATENT AND TRADEMARK OFFICE

CERTIFICATE OF CORRECTION

PATENT NO : 5,713,561

DATED : February 3, 1998

INVENTOR(S) : Shigeyuki SUGIYAMA

It is certified that error appears in the above-identified patent and that said Letters Patent is hereby corrected as shown below:

Title page, left hand column, item [75], please correct the address of the inventor from "Nigano-Ken" to --Nagano-Ken--

Signed and Sealed this

Twenty-seventh Day of October, 1998

*Attest:*

Bruce Lehman

BRUCE LEHMAN

*Attesting Officer*

*Commissioner of Patents and Trademarks*